US008588653B2

(12) United States Patent
Kidaka et al.

(10) Patent No.: US 8,588,653 B2
(45) Date of Patent: Nov. 19, 2013

(54) CORONA CHARGER INCLUDING SHUTTER

(75) Inventors: Hiroyuki Kidaka, Abiko (JP); Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 399 days.

(21) Appl. No.: 12/640,115

(22) Filed: Dec. 17, 2009

(65) Prior Publication Data

US 2010/0158571 A1 Jun. 24, 2010

(30) Foreign Application Priority Data

Dec. 19, 2008 (JP) ..... 2008-324480

(51) Int. Cl.
*G03G 15/02* (2006.01)

(52) U.S. Cl.
USPC ..... 399/172; 399/115; 399/171

(58) Field of Classification Search
USPC ..... 399/115, 170, 172
See application file for complete search history.

(56) References Cited

U.S. PATENT DOCUMENTS

| | | | | |
|---|---|---|---|---|
| 6,934,507 | B2 | 8/2005 | Ohki et al. | |
| 7,139,522 | B2 | 11/2006 | Ohki et al. | |
| 8,340,553 | B2 * | 12/2012 | Kidaka | 399/170 |
| 2004/0131406 | A1 | 7/2004 | Ohki et al. | |
| 2005/0276642 | A1 | 12/2005 | Ohki et al. | |
| 2007/0160389 | A1 * | 7/2007 | Zona et al. | 399/170 |
| 2008/0038011 | A1 | 2/2008 | Nakajima et al. | |
| 2010/0158550 | A1 * | 6/2010 | Makino et al. | 399/45 |

FOREIGN PATENT DOCUMENTS

| | | | |
|---|---|---|---|
| JP | 2001-175058 | A | 6/2001 |
| JP | 2005-343176 | A | 12/2005 |
| JP | 2005-353521 | A | 12/2005 |
| JP | 2007-072212 | A | 3/2007 |
| KR | 2005-0118657 | A | 12/2005 |

OTHER PUBLICATIONS

Notification of First Office Action dated Oct. 26, 2011, in Chinese Application No. 200910259422.X.

Decision on Grant—Patent for Invention dated Apr. 27, 2011, in Russian Application No. 2009147229/28(067297).

Search Report dated Mar. 16, 2010, in related European Application No. 09179677.1-2209.

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A charging device includes a corona charger for electrically charging a photosensitive member; a sheet-like member for covering and uncovering an opening of the corona charger; a regulating member for regulating a shape of the sheet-like member so that the sheet-like member is convex toward the corona charger with respect to a circumferential direction of the photosensitive member; and a winding-up member, including a winding-up shaft around which the sheet-like member is to be wound up, for winding up the sheet-like member so that a surface of the sheet-like member opposing the corona charger is directed toward a winding-up center of the winding-up shaft when the sheet-like member is wound up by the winding-up shaft.

9 Claims, 10 Drawing Sheets

(A)

(B)

(C)

(A) CONDITION 1

(B) CONDITION 2

(C) CONDITION 3

(D) CONDITION 4

CORONA CHARGER INCLUDING SHUTTER

FIELD OF THE INVENTION AND RELATED ART

The present invention relates to a corona charger used in an image forming apparatus, such as a copying machine, a printer, or a facsimile machine.

In an image forming apparatus of an electrophotographic type, an image has been conventionally formed through an electrophotographic process including steps of charging, exposure, development and transfer. Of these steps, in the charging step a photosensitive member has been electrically charged uniformly to a potential of a predetermined polarity by a corona charger provided closely to the photosensitive member. In the charging step using the corona charger, corona discharge is utilized, so that an electric discharge product such as ozone ($O_3$) or nitrogen oxides ($NO_x$) is generated. When such an electric discharge product is deposited on the photosensitive member and takes up moisture, a so-called "image deletion (flow)" phenomenon such that a surface resistance at a opening on which the electric discharge product is deposited is lowered, thus failing to faithfully reproduce an electrostatic latent image depending on image information.

Japanese Laid-Open Patent Application (JP-A) 2007-072212 discloses prevention of deposition of the electric discharge product on the photosensitive member during non-image formation by providing a shutter to the corona charger so as to cover an opening of the corona charger. According to a study by the present inventors, as shown in FIG. 1, in the case where a corona charger 200 is intended to be brought nearer to a photosensitive member 100 compared with a conventional image forming apparatus, the following findings have been obtained. Incidentally, a reference symbol 200*a* represents a grid electrode. As shown in FIG. 2, it has been found that a sheet-like shutter 1000 capable of being wound up may preferably be employed so as not to deteriorate the photosensitive member 100 even when the shutter can contact the photosensitive member 100 by bringing the corona charger 200 near to the photosensitive member 100. Further, it has been found that the photosensitive member 100 has a cylindrical shape and therefore prevention measures against interference of the sheet-like shutter 1000 with the photosensitive member 100 may preferably be taken. Specifically, it has been found that a shape of the sheet-like shutter 1000 may preferably be regulated so that a central portion of the sheet-like shutter 1000 is closer to the corona charger 200 than both end portions of the sheet-like shutter 1000 with respect to a widthwise direction of the sheet-like shutter 1000 (a direction perpendicular to the drawing sheet of FIG. 2).

However, in the case where such a sheet-like shutter 1000 is wound up around a winding-up roller 400 by using a shutter driving mechanism 300 as shown in FIG. 2, it has been turned out that inconvenience is caused to occur. Specifically, in the case where the sheet-like shutter 1000 is wound up with the surface facing the corona charger 200 outside, it has been found that a portion in the neighborhood of the central portion of the sheet-like shutter 1000 with respect to the widthwise direction of the sheet-like shutter 1000 is considerably bent toward the corona charger 200. When the considerable bending is caused with respect to the sheet-like shutter 1000, the sheet-like shutter 1000 interferes with the corona charger 200, so that there arises such a problem that opening and closing movement of the sheet-like shutter 1000 cannot be performed properly.

SUMMARY OF THE INVENTION

A principal object of the present invention is to provide a charging device capable of preventing improper opening and closing movement of a sheet-like member caused by bending of the sheet-like member for covering and uncovering an opening of a corona charger.

According to an aspect of the present invention is to provide a charging device comprising:

a corona charger for electrically charging a photosensitive member;

a sheet-like member for covering and uncovering an opening of the corona charger;

regulating means for regulating a shape of the sheet-like member so that a central portion of the sheet-like member protrudes toward the corona charger with respect to a widthwise direction of the sheet-like member; and winding-up means for winding up the sheet-like member such a surface of said sheet-like member as is remote from the photosensitive member is inside.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 5(A), 5(B) and 5(C) are schematic views each showing a charger shutter winding-up mechanism, wherein FIG. 5(A) shows a state in which the charger shutter is opened in a constitution according to the present invention, FIG. 5(B) shows a state in which the charger shutter is closed in the constitution according to the present invention, and FIG. 5(C) shows a state in which the charger shutter is opened in a constitution in Comparative Embodiment.

FIGS. 6(A), 6(B) and 6(C) are schematic views of an opening and closing mechanism of the charger shutter and the charger shutter winding-up mechanisms, wherein FIG. 6(A) is a sectional view of the opening and closing mechanism, FIG. 6(B) is a perspective view of the opening and closing mechanism, and FIG. 6(C) is a sectional view of the charger shutter winding-up mechanism.

FIGS. 12(A) to 12(D) are schematic sectional views each showing charger shutter set conditions depending on the presence or absence of the curvature shape imparting mechanism or a difference in winding-up direction, wherein FIG. 12(A) shows a condition 1 in a constitution according to the present invention, and FIGS. 12(B), 12(C) and 12(D) show conditions 2, 3 and 4, respectively, in constitutions in Comparative Embodiment.

FIGS. 13(A) and 13(B) are schematic perspective views showing a charger shutter opening and closing mechanism, wherein FIG. 13(A) shows a state in which the charger shutter is opened and FIG. 13(B) shows a state in which the charger shutter is closed.

DETAILED DESCRIPTION OF THE PREFERRED EMBODIMENTS

Figure 1:
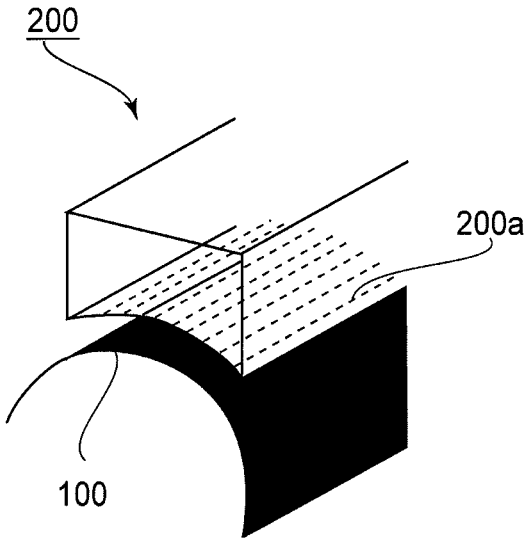
FIG.1 PRIOR ART
FIG. 1 is a schematic perspective view showing a positional relationship between a photosensitive member and a charging device.
Figure 2:
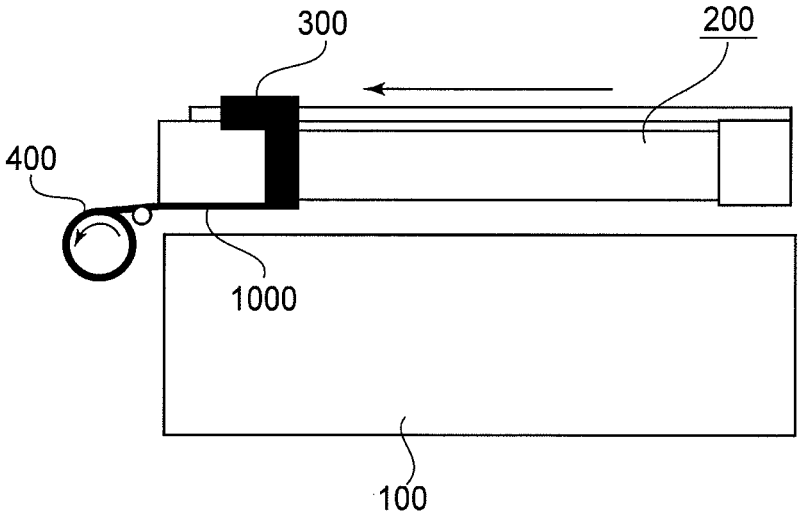
FIG.2 PRIOR ART
FIG. 2 is a schematic sectional view showing a charger shutter winding-up mechanism in Comparative Embodiment.

Hereinbelow, embodiments according to the present invention will be described with reference to the drawings. Incidentally, in the respective drawings, members or means indicating by identical reference numerals or symbols have the same constitutions or functions, thus being appropriately omitted from redundant explanation.

Embodiment 1

First, a general structure of the image forming apparatus will be described with reference to FIG. 3. The image forming apparatus in this embodiment is a laser beam printer of an electrophotographic type.

(General Structure of Image Forming Apparatus)

Figure 3:
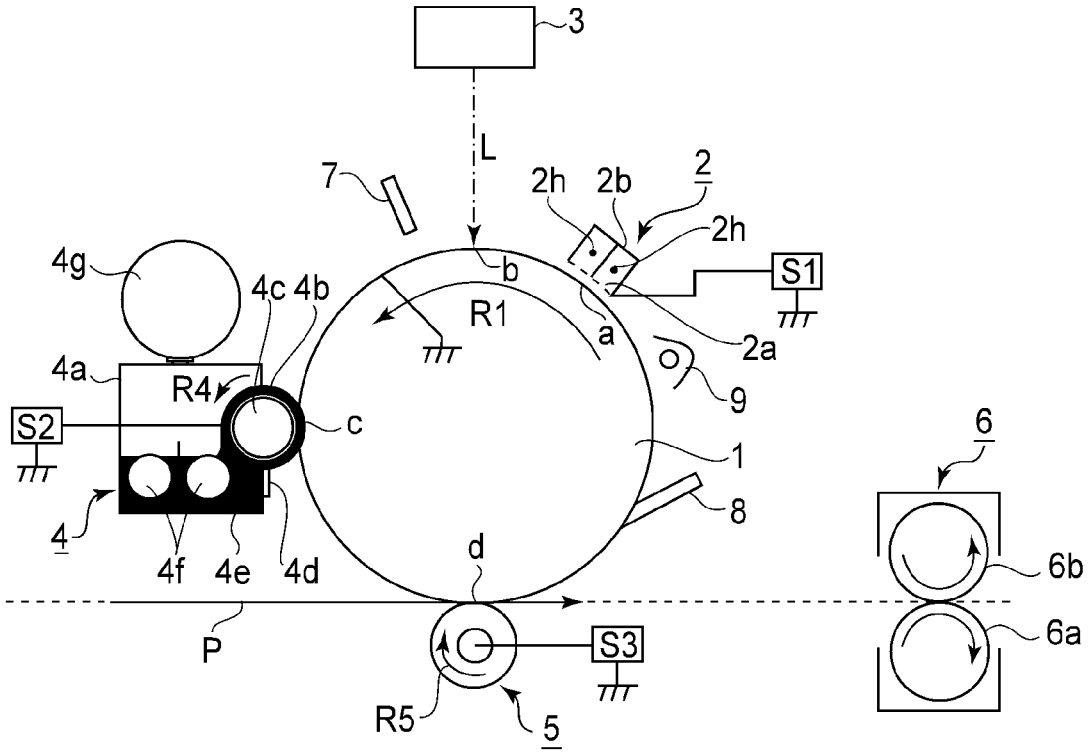
FIG. 3 is a schematic sectional view of an image forming apparatus.

As shown in FIG. 3, a charging device 2, an exposure device 3, a potential measuring device 7, a developing device 4, a transferring device 5, a cleaning device 8, and an optical discharging device 9 and disposed in this order around a photosensitive member (image bearing member) 1 along a rotational direction (indicated by an arrow R1) of the photosensitive member 1. Further, a fixing device 6 is disposed downstream of the transferring device 5 with respect to a conveying direction of a recording material P.

Next, individual image forming devices associated with image formation will be described specifically.

(Photosensitive Member)

The photosensitive member 1 in this embodiment as the image bearing member is a cylindrical (drum-type) electrophotographic photosensitive member as shown in FIG. 3. The photosensitive member 1 has a diameter of 84 mm and is rotationally driven in the arrow R1 direction about a center shaft (not shown) at a process speed (peripheral speed) of 500 mm/sec.

Figure 4:
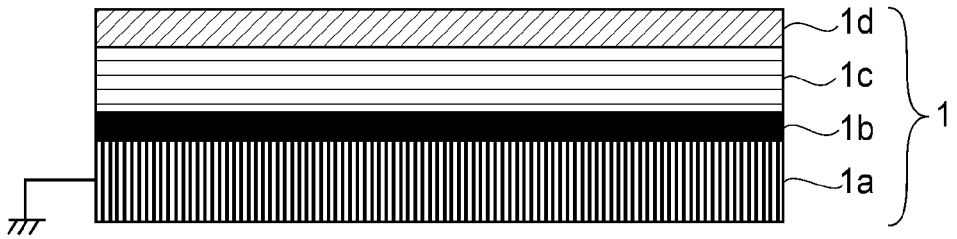
FIG. 4 is a schematic sectional view showing a layer structure of the photosensitive member.

Further, as shown in FIG. 4, the photosensitive member 1 includes a photosensitive layer of a negatively chargeable organic photoconductor. Specifically, the photosensitive member 1 includes an aluminum cylinder 1*a* as an electroconductive support at an inner position with respect to a radial direction (a lower portion in FIG. 4). On the cylinder 1*a*, a three-layer structure consisting of an under coat layer 1*b* for suppressing interference of light and improving an adhesiveness with an upper layer, a charge generation layer 1*c*, and a charge transport layer 1*d* is formed. The charge generation layer 1*c* and the charge transport layer 1*d* constitute the photosensitive layer described above.

(Charging Device)

Figure 6:
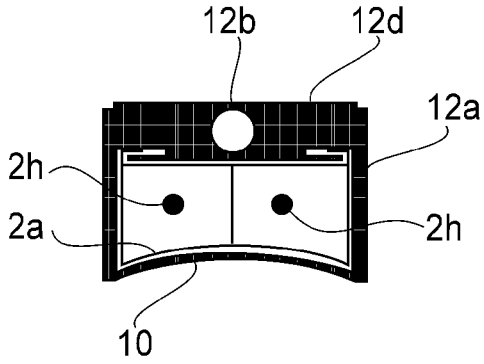
Figure 6:
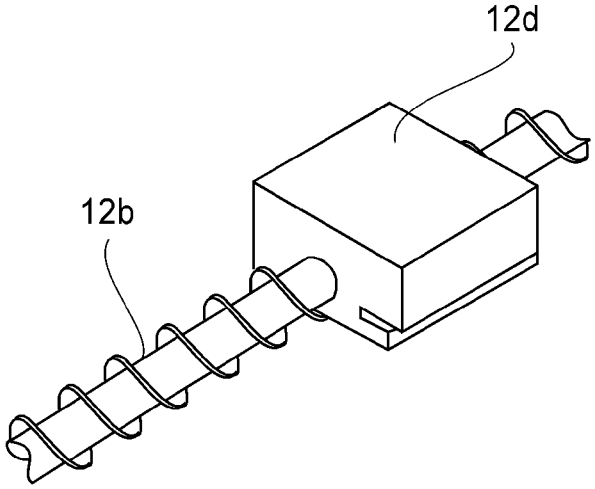
Figure 6:
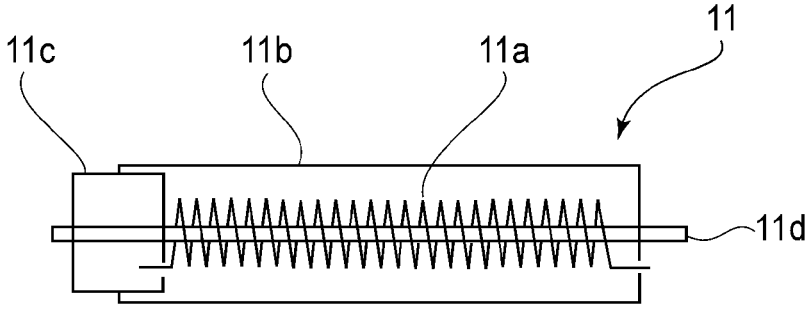

The charging device 2 in this embodiment is, as shown in FIG. 3, a corona charger of a scorotron type including a discharging wire 2*h*, a U-shaped electroconductive shield 2*b* which is provided so as to surround the discharging wire, and a grid electrode 2*a* provided at an opening of the shield 2*b*. In this embodiment, in order to meet high-speed image formation, the corona charger 2 includes two discharging wire 2*h* and a partition wall provided between the two discharging wires 2*h*. The corona charger 2 is provided along a generatrix direction of the photosensitive member 1. Therefore, a longitudinal direction of the corona charger 2 is parallel to an axial (shaft) direction of the photosensitive member 1. Further, as shown in FIG. 6(A), the grid electrode 2*a* is disposed along the circumferential surface of the photosensitive member so that a central portion thereof with respect to a widthwise (short) direction (a photosensitive member movement direction) is separated from the photosensitive member in a larger distance than that at both end portions thereof. Therefore, in this embodiment, compared with the conventional image forming apparatus, the corona charger 2 can be brought nearer to the photosensitive member 1, so that a charging efficiency can be improved.

Further, to the corona charger 2, a charging bias application source S1 for applying a charging bias is connected, so that the corona charger 2 has the function of uniformly charging the surface of the photosensitive member 1 to a potential of a negative polarity at a charging position a by the charging bias applied from the application source S1. Specifically, a charging bias in the form of a DC voltage biased with an AC voltage is applied to the discharging wires 2*h* and the grid electrode 2*a*.

(Exposure Device)

The exposure device 3 in this embodiment is a laser beam scanner including a semiconductor laser for irradiating the photosensitive member 1 charged by the corona charger 2 with laser light L. Specifically, on the basis of an image signal (information) sent from a host computer connected to the image forming apparatus through a network cable, the image exposure device 3 outputs the laser light L. The charged surface of the photosensitive member 1 is exposed to the laser light L along a main scan direction at an exposure position b. By repeating the exposure along the main scan direction during the rotation of the photosensitive member 1, of the charged surface of the photosensitive member 1, a portion irradiated with the laser light L is lowered in potential, so that an electrostatic latent image is formed correspondingly to the image information.

Here, the main scan direction means a direction parallel to the generatrix of the mechanism 1 and a sub-scan direction means a direction parallel to the rotational direction of the photosensitive member 1.

(Developing Device)

The developing device 4 deposits a developer (toner) on the electrostatic latent image formed on the photosensitive member 1 by the charging device 2 and the exposure device 3 to visualize the latent image. The developing device in this embodiment employs a two component magnetic brush developing method and also employs a reverse developing method. The developing device 4 includes a developing container 4*a*, a developing sleeve 4*b*, a magnet 4*c*, a developing blade 4*d*, a developer stirring member 4*f*, and a toner hopper 4*g*. Incidentally, a reference symbol 4*e* shown in FIG. 3 represents a two component developer accommodated in the developing container 4*a*. The developing sleeve 4*b* is a non-magnetic cylindrical member and is rotatably provided to the developing container 4*a* while a part of an outer peripheral surface thereof is outwardly exposed. The magnet 4*c* is provided in the developing sleeve 4*b* in a state in which it is non-rotatable and fixed. The developing blade 4*d* regulates a thickness of the two component developer 4*e* coated on the developing sleeve surface. The developer stirring member 4*f* is disposed on a bottom side in the developing container 4*a* and feeds the two component developer 4*e* toward the developing sleeve 4*b* while stirring the developer. The toner hopper 4g is a container containing toner to be supplied to the developing container 4a. The two component developer 4e in the developing container 4a is a mixture of the toner and a magnetic carrier and is stirred by the developer stirring member 4f. The magnetic carrier has a resistance of about $10^{13}$ ohm·cm and a particle size of 40 μm. The toner is triboelectrically charged to a negative polarity by rubbing with the carrier. The above-described developing sleeve 4b is disposed oppositely to the photosensitive member 1 so as to provide the closest distance of 350 μm from the photosensitive member 1. A portion at which the photosensitive member 1 and the developing sleeve 4b oppose each other constitutes a developing portion c. The developing sleeve 4b is rotationally driven so that a movement direction of its surface is opposite from the movement direction of the photosensitive member 1 surface at the developing portion c. That is, the developing sleeve 4b is rotationally driven in a direction indicated by an arrow R4 with respect to the arrow R1 direction of the photosensitive member 1. A part of the two component developer 4e in the developing container 4a is held as a magnetic brush layer at the outer peripheral surface of the developing sleeve 4b by a magnetic force of the inner magnet 4c and is fed to the developing portion c by the rotation of the developing sleeve 4b. The magnetic brush layer is regulated as a predetermined thin layer by the developing blade 4d, so that the layer contacts the photosensitive member 1 at the developing portion c.

To the developing sleeve 4b, a developing bias application source S2 is connected, and the toner in the developer carried on the surface of the developing sleeve 4b is selectively deposited correspondingly to the electrostatic latent image on the photosensitive member 1 by an electric field generated by a developing bias applied from the application source S2. As a result, the electrostatic latent image is developed as the toner image. In this embodiment, the toner is deposited at an exposed portion (laser light irradiation portion) on the photosensitive member 1, so that the electrostatic latent image is reversely developed. At this time, a charge amount of the toner subjected to the development on the photosensitive member 1 is about −25 μC/g. The developer on the developing sleeve 4b having passed through the developing portion c is collected in the developing container 4a by subsequent rotation of the developing sleeve 4b.

Further, in order to keep the toner content of the two component developer 4e in the developing container 4a in a substantially constant range, an optical toner content sensor is provided in the developing container 4a. The toner in an amount corresponding to the toner content detected by the toner content sensor is supplied from the toner hopper 4g to the developing container 4a.

(Transfer Device)

The transfer device 5 in this embodiment includes a transfer roller 5 as shown in FIG. 3. The transfer roller 5 is urged against the surface of the photosensitive member 1 with a predetermined urging force to form a nip therebetween as a transfer portion d. To the transfer portion d, the recording material P (e.g., paper or a transparent film) is sent from a sheet-feeding cassette with predetermined control timing.

The recording material P sent to the transfer d is subjected to transfer of the toner image formed on the photosensitive member 1 while being nip-conveyed between the photosensitive member 1 and the transfer roller 5. At this time, to the transfer roller 5, a transfer bias (+2 KV in this embodiment) of an opposite polarity to the normal charge polarity (negative) of the toner is applied from a transfer bias application source S3.

(Fixing Device)

The fixing device 6 in this embodiment includes a fixing roller 6a and a pressing roller 6b as shown in FIG. 3. The recording material P on which the toner image is transferred by the transfer device 5 is conveyed to the fixing device in which the toner image is heated and pressed between the fixing roller 6a and the pressing roller 6b to be fixed on the recording material P. The recording material P subjected to the fixing is then discharged outside the image forming apparatus.

(Cleaning Device)

The cleaning device 8 in this embodiment includes, as shown in FIG. 3, the cleaning blade. After the toner image is transferred on the recording material P by the transfer device 5, untransferred toner remaining on the photosensitive member 1 surface is removed by the cleaning blade.

(Optical Discharging Device)

The optical discharging device 9 in this embodiment includes, as shown in FIG. 3, a discharging exposure lamp. Residual charges remaining on the surface of the photosensitive member 1 subjected to the cleaning by the cleaning device 8 are removed by light irradiation by the discharging exposure lamp.

A series of the image forming process described above is completed and the image forming apparatus prepares for a subsequent image forming process.

(Charger Shutter)

Then, a charger shutter 10 as a sheet-like member for covering and uncovering the opening of the corona charger 2 will be described.

Figure 5:
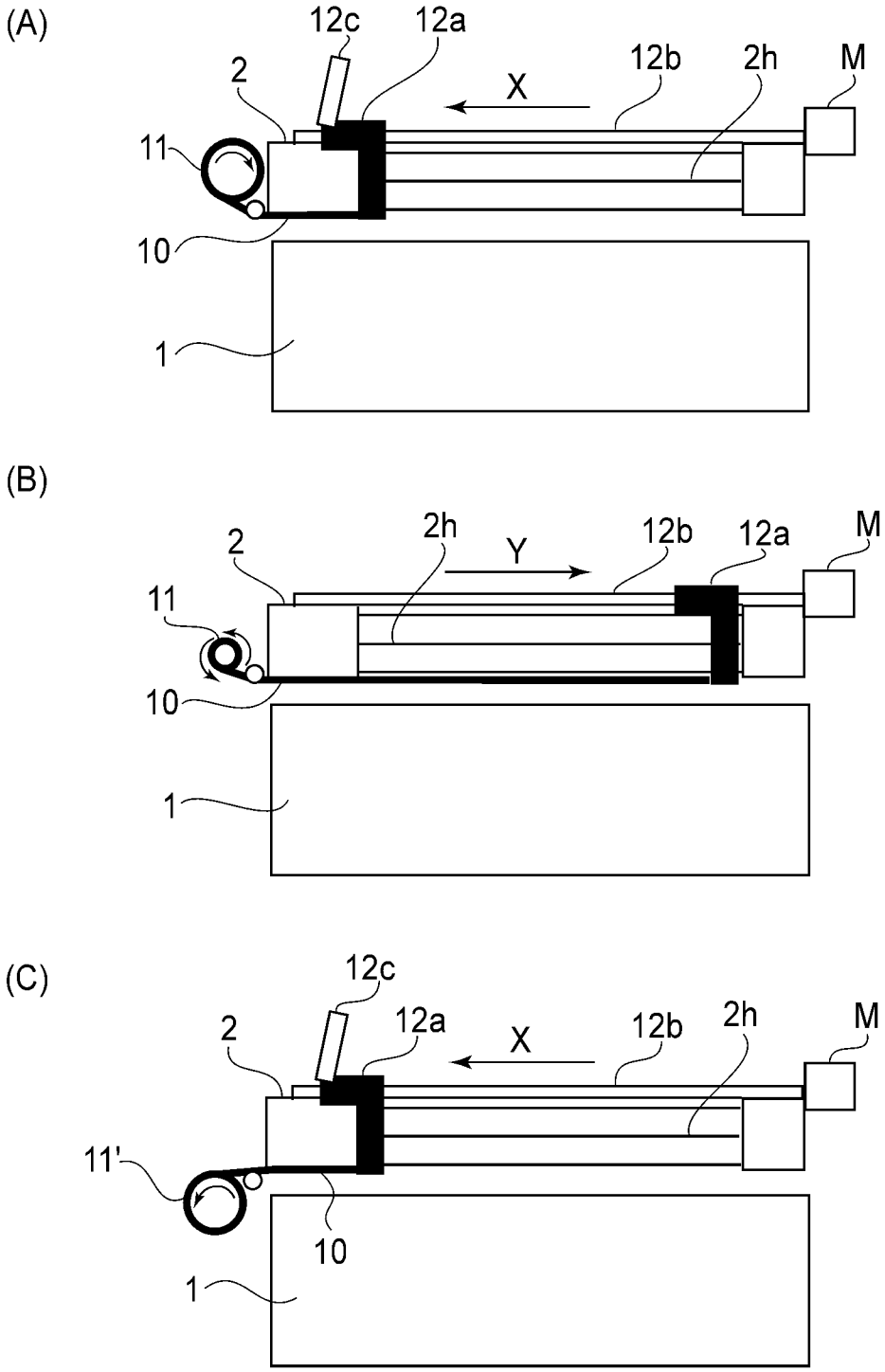

FIG. 5(A) shows a state in which the charger shutter 10 as the sheet-like member is opened by being wound up so as to move in X direction.

In this embodiment, as shown in FIG. 5(A), a sheet-like shutter capable of being wound up in a roll shape by a winding-up device 11 is employed as the charger shutter 10 for covering and uncovering the opening of the corona charger 2. This is not only because of prevention of passing of the corona discharge product falling from the corona charger 2 onto the photosensitive member 1 but also because of prevention of the photosensitive member 1 from being damaged to cause image defect when the charger shutter contacts the photosensitive member 1 by some possibility. Therefore, in this embodiment, as the charger shutter 10, a 30 μm-thick sheet-like member formed of polyimide resin is employed.

Further, as shown in FIG. 6(A), the charger shutter 10 has been subjected to heat treatment in advance so that the shape of the charger shutter 10 substantially follows the shape of curvature of the circumferential surface of the photosensitive member 1.

In the a heat treatment, first, the charger shutter 10 is brought into intimate contact with a hollow metal roller having a diameter equal to that (84 mm in this embodiment) of the photosensitive member 1 and is fixed to the metal roller. Then, the metal roller to which the charger shutter 10 is fixed is left standing for about 10 minutes in a state in which the metal roller is heated from the inside thereof by a heating source so as to be kept at a predetermined temperature (150° C. in this embodiment). As a result, the shape of curvature can be imparted to the charging shutter 10 in advance so as to substantially follow the shape of curvature of the circumferential surface of the photosensitive member. Incidentally, with respect to the curvature shape imparting treatment (processing), in place of the above-described heat treatment, it is also possible to employ other treatment methods.

Therefore, the central portion of the charger shutter 10 with respect to the widthwise direction (the photosensitive member movement direction) of the charger shutter 10 has a shape such that it protrudes toward or in convex toward the corona charger 2. By imparting such a shape to the charger shutter 10, a gap between the corona charger 2 (the grid electrode 2*b*) and the photosensitive member 1 is decreased as small as possible.

Incidentally, within a range not hindering the opening and closing operation of the charger shutter 10, the shape of curvature of the charger shutter 10 is not necessarily required to coincide with the shape of curvature of the circumferential surface of the photosensitive member 1.

Further, in order to reduce a space during retraction (opening) of the charger shutter 10, during image formation, the charger shutter 10 is configured to be retracted toward one end side in a roll shape with respect to the longitudinal direction of the corona charger 2 (main scan direction).

(Charger Shutter Opening and Closing Mechanism)

The opening and closing mechanism (moving mechanism) for the charger shutter 10 will be described. FIGS. 5(A) and 5(B) show, the states in which the charger shutter 10 is in an open state and a closed state, respectively. FIGS. 6(A), 6(B) and 6(C) show the opening and closing mechanism for the charger shutter 10.

The opening and closing mechanism includes a driving motor M, a movable member 12*a*, a rotatable member 12*b*, a connecting member 12*d*, and a winding-up device 11 and performs the function of moving the charger shutter 10 along the longitudinal direction (the main scan direction) of the charger shutter 10 so as to be opened and closed.

In this embodiment, a shutter detecting device 12*c* for detecting completion of an opening operation of the charger shutter 10 is provided. The shutter detecting device 12*c* includes a photointerruter. When the movable member 12*a* reaches the opening operation completion position, the opening operation completion of the opening operation completion of the charger shutter 10 is detected by utilizing light-blocking of the photo-interrupter by the movable member 12*a*. That is, at the time when the shutter detecting device 12*c* detects the movable member 12*a*, the rotation of the motor M is stopped.

One end of the charger shutter 10 is, as shown in FIG. 6(A), connected to the movable member 12*a*. The movable member 12*a* is driving connected to the rotatable member 12*b* and is formed integrally with the connecting member 12*d*.

The rotatable member 12*b* is provided with a spiral groove as shown in FIG. 6(B) and is connected to the driving motor M as shown in FIGS. 5(A) and 5(B). When the rotatable member 12*b* is rotationally driven by the driving motor M, the connecting member 12*d* threadably mounted on the rotatable member 12*b* moves in the main scan direction (X or Y direction) along the spiral groove. The connecting member 12*d* is threadably mounted on the rotatable member 12*b* so as to be movable only in the main scan direction on a rail provided on the shield 2*b*, thus being prevented from rotating together with the rotatable member 12*b*. Specifically, a recess portion provided at both end portions of the connecting member 12*d* as shown in FIG. 6(B) is engaged with the rail.

Therefore, when the rotatable member 12*b* is driven by the driving motor M, through the movable member 12*a* formed integrally with the connecting member 12*d*, a moving force toward the opening and closing direction is transmitted to the charger shutter 10.

Further, as shown in FIG. 6(C), the winding-up mechanism 11 as a winding-up means includes a cylindrical winding-up roller (winding-up member) 11*b* for fixing one end of the charger shutter 10 and for winding up the charger shutter 10 and includes a spring (urging member) 11*a* provided in the winding-up roller 11*b*.

The winding-up roller 11*b* includes a roller body rotatable about a shaft member 11*d* to wind up the charger shutter 10 about its outer peripheral surface and includes a fixed roller 11*c* which is fixed to the shaft member 11*c* in a non-rotatable manner. One end of the spring 11*a* provided so that the shaft member 11*d* passes through the spring 11*a* is fixed to the roller body and the other end of the spring 11*a* is fixed to the fixed roller 11*c*. Therefore, at both end portions of the spring 11*a*, by the rotation of the winding-up roller 11*b*, bending stress due to torsion is applied to the spring 11*a*.

Accordingly, when the charger shutter 10 is opened (FIG. 5(A)), in interrelation with the movement of the charger shutter 10 in X direction by the motor M, the winding-up roller 11*b* winds up the charger shutter 10 at any time with no downward slack of the charger shutter 10. That is, the charger shutter 10 is placed in a state in which it is always urged in X direction by the spring 11*a* in the winding-up roller 11*b*.

On the other hand, when the charger shutter 10 is closed (FIG. 5(B)), the driving motor M pulls the charger shutter 10 from the winding-up roller 11*b* against the urging force of the spring 11*a* in the winding-up roller 11*b*, so that the charger shutter 10 is moved in the Y direction. Incidentally, in a state in which the charger shutter 10 is completely closed, the urging force toward the X direction by the spring 11*a* in the winding-up roller 11 acts on the charger shutter 10, so that the charger shutter 10 does not slack downward. Further, in order to keep the shape of curvature of the charger shutter 10 which has been permanent-set (permanent-bent) in advance when the charger shutter 10 is closed, the charger shutter 10 is under tension to some extent by the urging force toward the X direction by the spring 11*a* in the winding-up 11.

Therefore, when the charger shutter 10 is closed, it is possible to maintain a state in which the corona discharge product is less liable to be leaked to the outside.

(Charger Shutter Winding-Up Direction)

Figure 7:
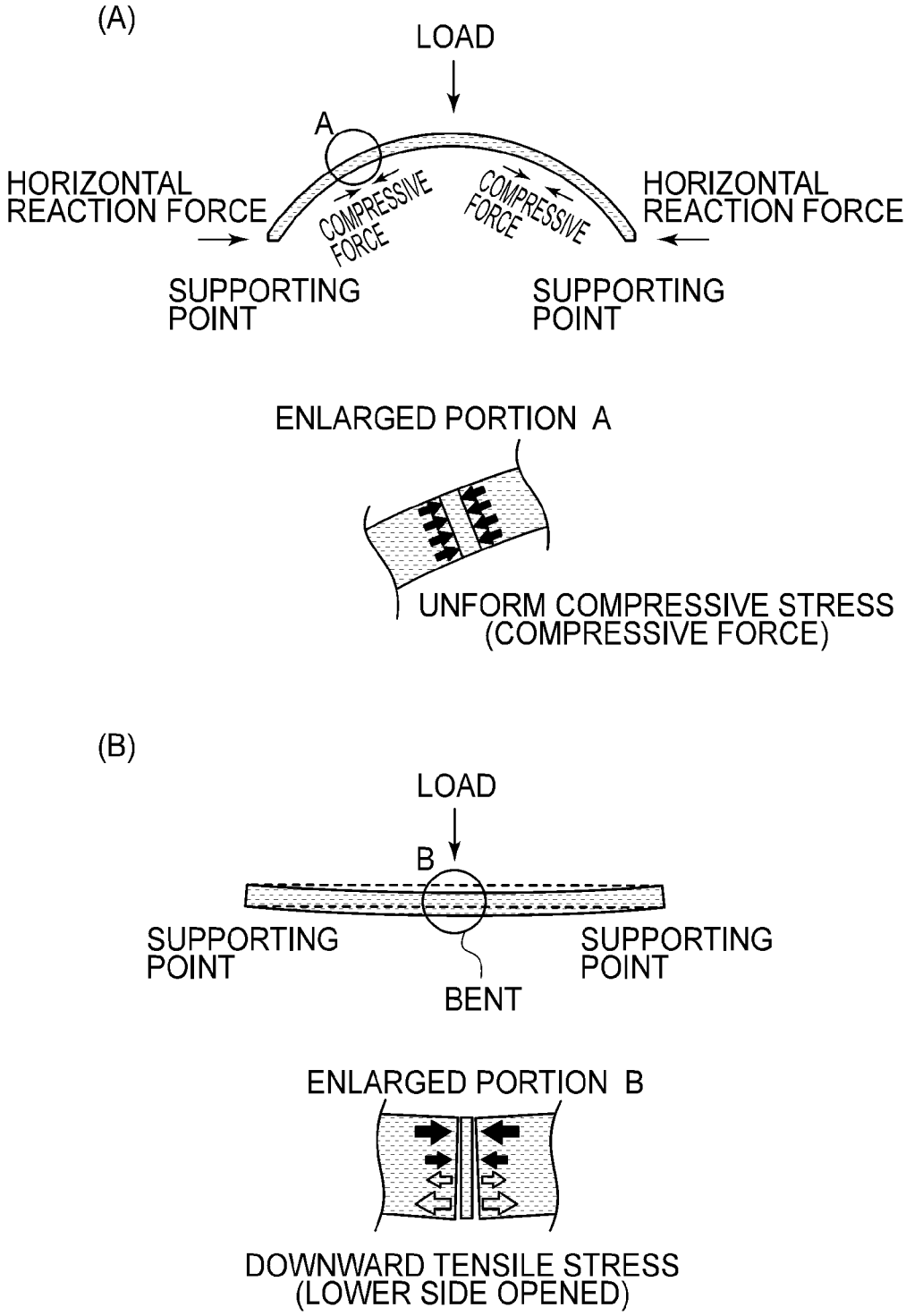
FIGS. 7(A) and 7(B) are schematic views for illustrating a principle of absorbing permanent set caused with respect to the charger shutter in a wound up state.

FIG. 5(C) shows Comparative Embodiment in which the charger shutter winding-up direction is opposite from that in this embodiment, and FIGS. 7(A) and 7(B) are schematic views for illustrating a principle of an occurrence of bending of the charger shutter 10.

In this embodiment, when the charger shutter 10 is opened at the time of starting the image forming operation (FIG. 5(A)), the charger shutter 10 is configured to be wound up by the winding-up roller 11 so that a convex surface of the shape of curvature of the charger shutter 10 which has been permanent-set in advance in inside.

This is because permanent set (permanent bending) generated with respect to the charger shutter 10 when the charger shutter 10 is left standing for a long time in the open state in the case where the charger shutter 10 is wound up so that the convex surface of the shape of curvature of the charger shutter 10 is outside can be obviated. That is because, in Comparative Embodiment, the shape of curvature imparted to the charger shutter 10 in advance is encouraged by the permanent set through the winding up.

Therefore, in the case of Comparative Embodiment, due to the permanent set, the charger shutter 10 (particularly at a portion in the neighborhood of its longitudinal control portion) is considerably bent toward the corona charger 2, so that there is a possibility the opening and closing movement of the charger shutter 10 is hindered. Further, the considerable bending leads to transfer of the toner and the electric discharge product from the inner surface of the charger shutter 10 onto the grid electrode 2*a*, with the result that improper charging is caused due to a partial fluctuation in electric resistance of the grid electrode 2*a*, thus resulting in image defect.

On the other hand, in this embodiment, in this embodiment, the charger shutter 10 is configured to be wound up by the winding-up roller 11*b* so that the convex surface of the shape of curvature of the charger shutter 10 is inside, so that the above problem is not caused to occur.

That is, by employing the winding-up direction as in this embodiment, the preliminary imparted bending of the charger shutter 10 toward the corona charger 2 is alleviated by the permanent set, so that it becomes possible to suppress the occurrence of the considerable bending toward the corona charger 2.

Incidentally, in this embodiment, the degree of the bending of the charger shutter 10 is alleviated to the extent that the shape of curvature imparted to the charger shutter 10 in advance is not lost. Therefore, when the charger shutter 10 is closed, the charger shutter 10 (particularly at the portion in the neighborhood of its longitudinal central portion) does not contact the photosensitive member 1. As a result, it is possible to prevent the sheet-like member from being improperly subjected to the opening and closing movement due to the bending of the sheet-like member.

Here, with reference to FIGS. 7(A) and 7(B), a principle of absorbing the bending of the charger shutter 10, which has been permanent-set in advance, toward the photosensitive member 1 due to the permanent set (permanent bending) will be described. FIGS. 7(A) and 7(B) are schematic views of the charger shutter as seen from its longitudinal one end side of the charger shutter, wherein FIG. 7(A) shows the case of this embodiment and FIG. 7(B) shows the case of Comparative Embodiment.

FIG. 7(A) shows the case where an external load, i.e., a force exerted in a direction in which the permanent set is eliminated by the winding-up roller is applied to the charger shutter which has been permanent-set in advance so as to have the shape of curvature.

In this case, the load merely caused an occurrence of uniform compressive stress in a substantially cross section and is converted into compressive force, thus being transmitted to both end supporting points. When the load is converted into the compressive force and is transmitted to the both ends, the charger shutter exhibits behavior such that it opens outward, so that a force directed in a horizontal direction occurs at the both ends. The shape of curvature memorized by the charger shutter in advance is exerted as horizontal reaction force in a direction in which the horizontal force is cancelled, so that "bending" less occurs with respect to the charger shutter and therefore the degree of bending of the charger shutter toward the photosensitive member 1 can be decreased.

On the other hand, as shown in FIG. 7(B), with respect to the charger shutter which has not permanent-set, large compressive stress and tensile stress occur inside the charger shutter, so that the bending of the charger shutter toward the photosensitive member 1 occurs due to "bending".

Incidentally, in this embodiment, the shape of curvature of the charger shutter 10 which has been permanent-set in advance follows the shape of curvature of the circumferential surface of the photosensitive member 1 but such a constitution is not necessarily required since greater curvature is effective in suppressing the above-described bending due to the load. For example, in the case where there is a difference in curvature between the corona charger 2 (the grid electrode 2*a*) and the photosensitive member 1, the curvature of the charger shutter 10 may preferably be set at a value larger than at least one of those of the corona charger 2 and the photosensitive member 1.

(Opening and Closing Control of Charger Shutter)

Figure 8:
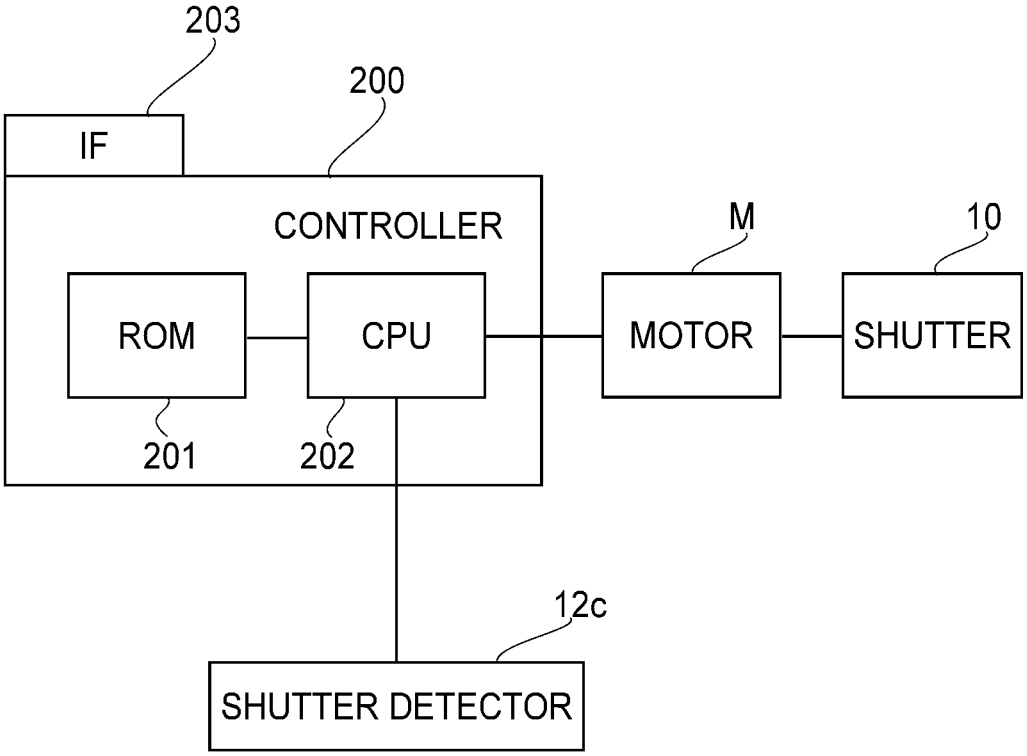
FIG. 8 is a block diagram for illustrating opening and closing control of the charger shutter.

Next, the opening and closing control of the charger shutter 10 will be described. FIG. 8 shows a block diagram for illustrating the opening and closing control of the charger shutter 10, and FIG. 9 shows control flow of the control.

As shown in FIG. 8, a controller portion 200 for controlling the opening and closing of the charger shutter 10 includes an ROM 201 in which a control program for realizing the opening and closing control of the charger shutter 10 is stored, and includes a CPU 202 for executing the opening and closing control in accordance with this control program. Further, the controller portion 200 is provided with an interface (input means) 203 through which information is input from a host computer via a network cable. The interface performs the function of obtaining the information from the host computer and sends the information to the CPU 202.

The CPU 202 executes the opening and closing of the charger shutter 10 by turning on and off the driving motor M connected to the charger shutter 10 through the movable member 12*a* and the like.

Figure 9:
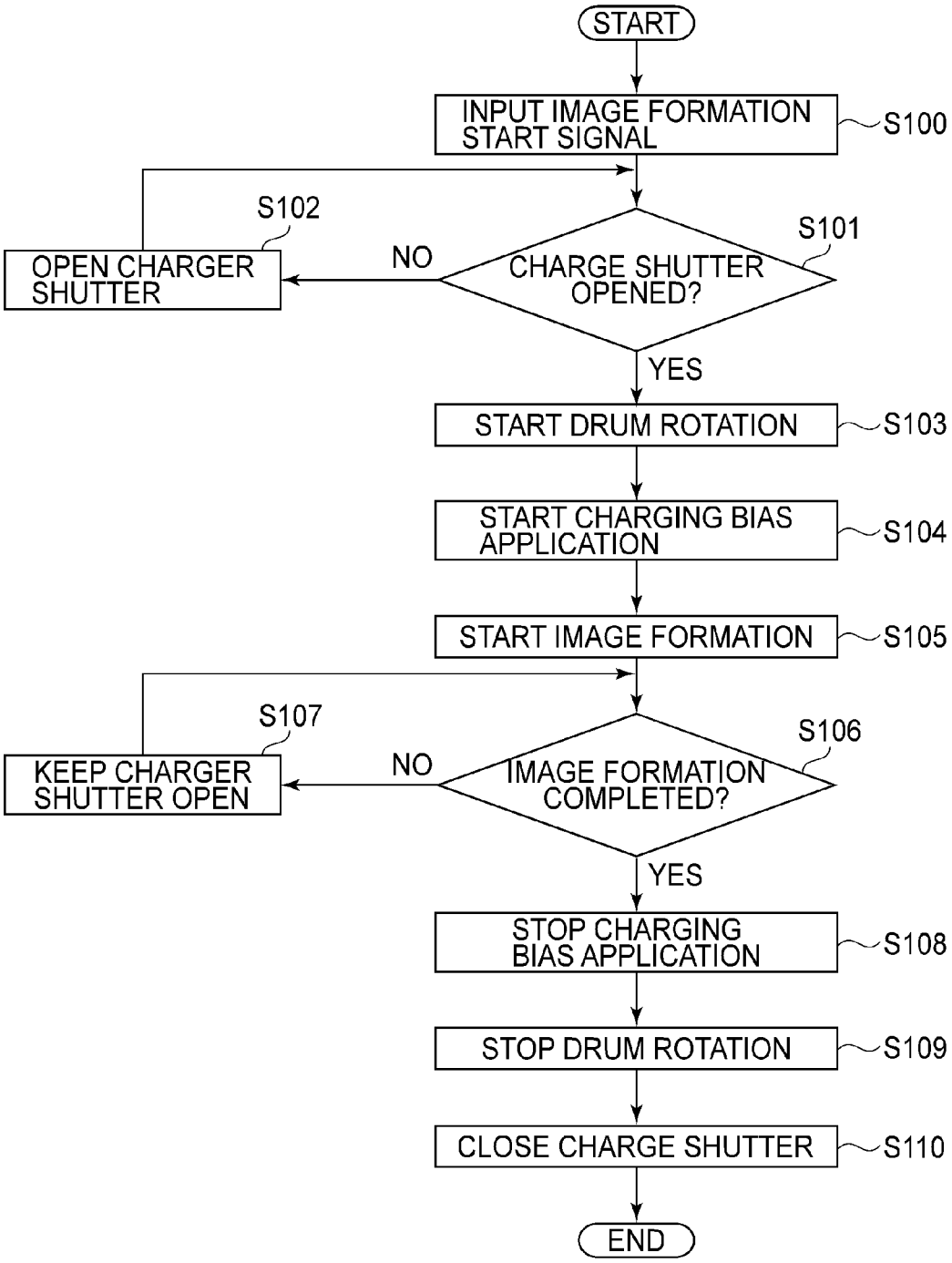
FIG. 9 is a flowchart for illustrating the opening and closing control of the charger shutter.

With reference to FIG. 9, the control flow during the execution of an image forming job, i.e., from input of an image formation start signal together with an image signal indicating information of an image to be output until a series of image forming processing is completed will be described. This control flow is processed and executed by the CPU 202. Incidentally, the above-described image signal and image formation start signal (image formation instruction signal) are input into the CPU 202 through the interface 203.

First, when the image formation start signal is input from the host computer (S100), whether or not the charger shutter 10 is located at the open position is judged on the basis of an output of the shutter detecting device 15 (S101).

In the case where the charger shutter 10 is not opened and is located at the closed position, the opening operation of the charger shutter 10 is executed (S102), and the processing is returned to the step S101. In the step S101, when the location of the charger shutter 10 at the open position is detected, a rotating operation of the photosensitive member 1 is started (S103). Then, after the start of the rotating operation of the photosensitive member 1, a charging bias is applied to the corona charger 2 (S104).

Then, upon completing preparatory operation of other image forming devices, image formation is started (S105).

Then, when the series of image formation is completed (S106), the charging bias application to the corona charger 2 is stopped (S108) and the rotation of the photosensitive member 1 is stopped (S109). Further, in the step S106, in the case where the image formation (image forming job) is judged as being not completed, the charger shutter 10 is controlled so as to be kept in the open state (S107).

Incidentally, in the case where an execution reservation of a subsequent image forming job is input, in the step S106, the judgement of "image formation completion" is not made and the subsequent image forming job is continued while the charger shutter 10 is kept in the open state (S107). That is, in the step S106, the judgement of "image formation completion" is made in the case where the execution reservation of the subsequent image forming job is not input from the start to completion of the current image forming job. Correspondingly to the stop of the rotation of the photosensitive member 1 (S109), the driving motor M is driven to rotate the rotatable member 13 in a direction opposite to the rotational direction of the rotatable member 12*b* during the opening operation, so that a closing operation of the charger shutter 10 is performed (S110) and the opening of the corona charger 2 is shielded (covered).

As described above, by setting the winding-up direction of the charger shutter 10 even when the charger shutter 10 is left standing for a long time in a wound-up state.

Further, the occurrence of improper charging due to transfer of the toner and the electric discharge product from the charger shutter 10 onto the photosensitive member 1 can be prevented. Therefore, a degree of the occurrence of image defect such as image density non-uniformity or stripes in the image can be alleviated.

Embodiment 2

Next, Embodiment 2 will be described. In this embodiment, members or means having the same functions as those described in Embodiment 1 are represented by the same reference numerals or symbols, thus being omitted from redundant description as long as there is no need.

The charger shutter has been permanent-set in advance so as to have the shape of curvature in Embodiment 1 but has been permanent-set in this embodiment. Instead, in this embodiment, a curvature shape imparting mechanism 12*e* as a regulating means is provided so that the charger shutter 10 has the same shape of curvature as that in Embodiment 1. This constitution will be specifically described.

Figure 10:
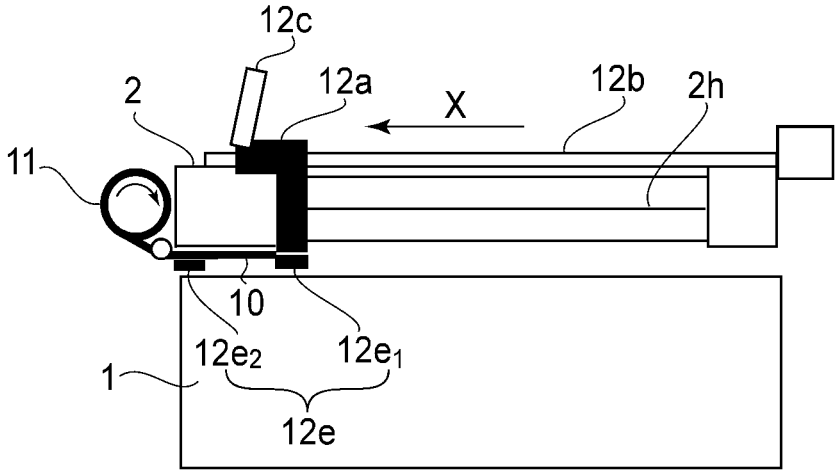
FIGS. 10 and 11 are schematic views showing a charging device including a curvature shape imparting mechanism.

FIG. 10 is a schematic view showing the charger shutter 10 and the corona charger 2. The curvature shape imparting mechanism 12*e* includes a charger shutter member 12$e_1$ and a curvature shape imparting member 12$e_2$ as a regulating member.

As shown in FIG. 10, on longitudinal one end side of the charger shutter 10 located outside a winding-up range of the winding-up roller 11*b*, the curvature shape imparting member 12$e_1$ as the regulating member is fixed so as to follow the shape of curvature of the circumferential surface of the photosensitive member 1. Therefore, the curvature shape imparting member 12$e_1$ is configured to more together with the charger shutter 10.

The curvature shape imparting member 12$e_1$ is a metal plate formed so as to follow the shape of curvature of the photosensitive member 1 and is attached to the surface of the charger shutter 10 facing the corona charger 2.

Thus, the curvature shape imparting member 12$e_1$ performs the function of permanent-setting the charger shutter 10 so as to have such a shape of curvature that a widthwise central portion of the charger shutter 10 protrudes toward the corona charger 2. Further, the curvature shape imparting member 12$e_1$ is bonded to the movable member 12*a* and its driving constitution is similar to that in Embodiment 1.

Further, as shown in FIG. 10, on a winding-up port side of the charger shutter 10 by the winding-up roller 11*b*, the curvature shape imparting member 12$e_2$ as the regulating member is provided. The curvature shape imparting member 12$e_2$ is, different from the case of the curvature shape imparting member 12$e_1$, provided at a position located outside the surface range of the winding-up roller 11*b* and close to the photosensitive member 1, thus forming such a relationship that the charger shutter 10 slides on the curvature shape imparting member 12$e_2$.

Figure 11:
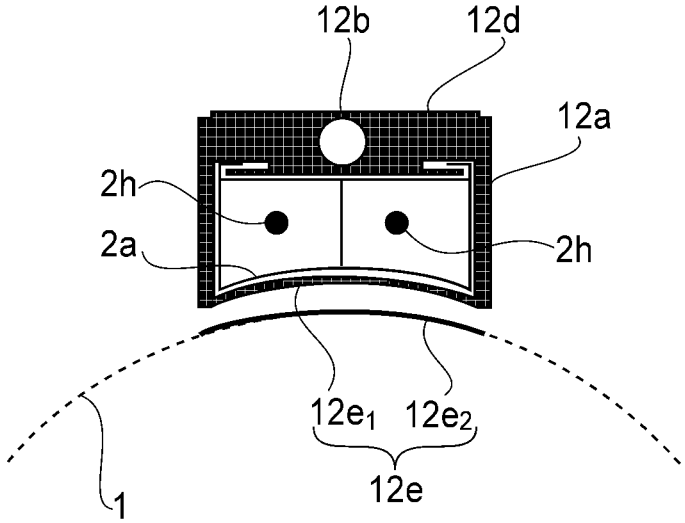
Figure 12:
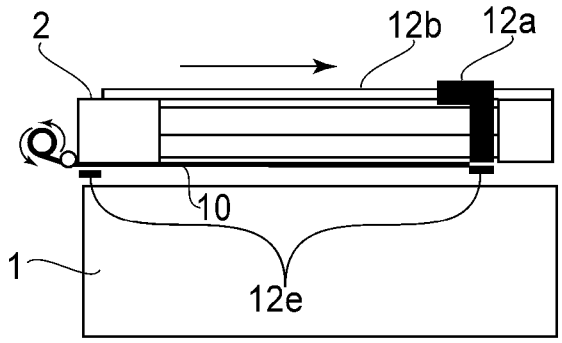
Figure 12:
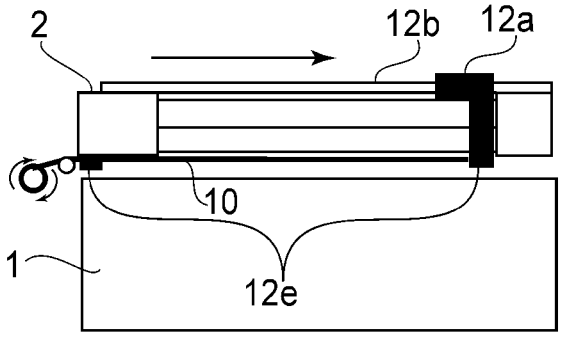
Figure 12:
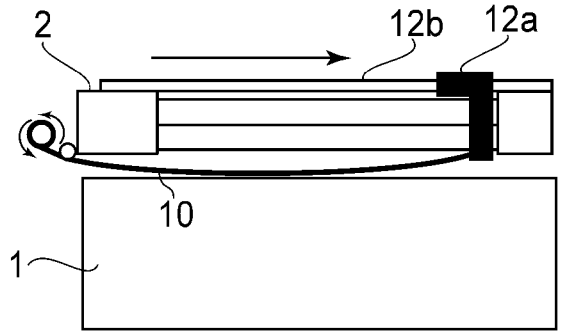
Figure 12:
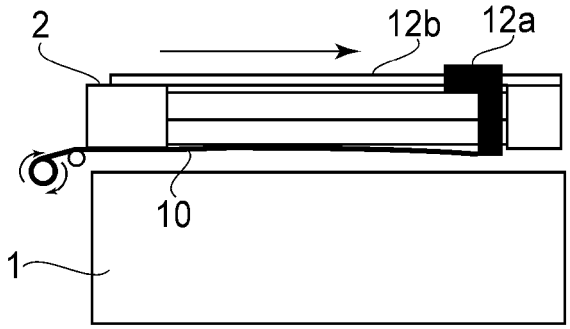

That is, the curvature shape imparting member 12$e_2$ has, as shown in FIG. 11, the function as a shutter inserting guide for guiding the charger shutter 10 into a small gap between the grid electrode 2*a* of the corona charger 2 and the photosensitive member 1. Further, the curvature shape imparting member 12$e_2$ also has a curvature shape imparting function for imparting the shape of curvature following the circumferential surface of the photosensitive member 1 formed in a gap between it and the grid electrode 2*a* of the corona charger 2 to the charger shutter 10.

Further, in this embodiment, similarly as in Embodiment 1, the winding-up direction of the charger shutter 10 is set. That is, the charger shutter 10 is wound up by the winding-up roller 11*b* so that the convex surface of the shape of curvature of the charger shutter 10 imparted by the curvature shape imparting mechanism 12*e* is inside.

Therefore, also in this embodiment, similarly as in Embodiment 1, it is possible to properly and stably perform the opening and closing operation of the charger shutter 10 even when the charger shutter 10 is left standing for a long time in the wound-up state. Further, it is possible to prevent the occurrence of the improper charging due to the transfer of the toner and the electric discharge product from the charger shutter onto the grid electrode. Therefore, it is possible to alleviate the degree of the occurrence of the image defect such as image density non-uniformity and stripes in the image.

An opening and closing operation property of the charger shutter and a degree of the occurrence of the image defect depending on the presence or absence of the curvature shape imparting member, a curvature shape imparting manner, and a difference in winding-up direction were verified.

Table 1 is a list showing set conditions of the charger shutter. Conditions 1 to 4 are as shown in FIGS. 12(A) to 12(D), respectively. The condition 1 corresponds to the constitution in this embodiment and the conditions 2 to 4 correspond to constitution in Comparative Embodiment.

TABLE 1

| Winding-up direction | Curvature shape imparting member | |
|---|---|---|
| | Presence | Absence |
| Inside convex*1 | Cond. 1 (FIG. 13(A)) | — |
| Outside convex*2 | Cond. 2 (FIG. 13(B)) | — |
| Inside*3 | — | Cond. 3 (FIG. 13(C)) |
| Inside*4 | — | Cond. 4 (FIG. 13(D)) |

*1The convex surface of the shape of curvature of the charger shutter is inside.
*2The convex surface of the shape of curvature of the charger shutter is outside.
*3The charger-side surface of the charger shutter is inside.
*4The charger-side surface of the charger shutter is outside.

Under each of the above four types of conditions image output on $50\times10^3$ sheets per day was continuously performed for about 8.5 hours and then the charger shutter was placed in the closed state for 15.5 hours. This image output was continued for 20 days, thus being performed on $1{,}000\times10^3$ sheets in total to verify the opening and closing operation property of the charger shutter and the degree of the occurrence of image defect. Every image output on $50\times10^3$ sheets, the opening and closing operation of the charger shutter was checked. That is, during the image output $50\times10^3$ sheets, the charger shutter was kept in the open state (the wound-up state in which the charger shutter was wound up by the winding-up roller).

Table 2 shows a result of the verification experiment under the four types of conditions (conditions 1 to 4).

TABLE 2

| Condition | Occurrence of failure*1 |
|---|---|
| 1 (FIG. 13(A)) | Not occurred. |
| 2 (FIG. 13(B)) | Occurred on $700\times10^3$ sheets |
| 3 (FIG. 13(C)) | Occurred on $450\times10^3$ sheets |
| 4 (FIG. 13(D)) | Occurred on $200\times10^3$ sheets |

*1Occurrence of improper opening and closing operation and occurrence of image defect.

Under the condition 1 corresponding to the constitution in this embodiment, even after the image output on $1,000\times10^3$ sheets, the amount of bending of the charger shutter resulting from the permanent set by the winding-up roller was less than 0.5 mm and the improper opening and closing operation was not caused to occur. Therefore, the image defect was also not caused to occur.

On the other hand, under the condition 2 corresponding to the constitution in Comparative Embodiment, the winding-up direction was opposite from that under the condition 1, so that the portion in the neighborhood of the longitudinal central portion of the charger shutter was bent toward the corona charger 2 by about 1.3 mm at the time of the image output on $700\times10^3$ sheets. As a result, the charger shutter caused the improper opening and closing operation and at the same time, the image defect was caused to occur due to the transfer of the toner and the electric discharge product from the charger shutter onto the grid electrode.

Further, under the condition 3 corresponding to another constitution in Comparative Embodiment, the charger shutter was wound up without being permanent-set so that the corona charger-side surface was inside, so that the portion in the neighborhood of the longitudinal central portion of the charger shutter was bent toward the photosensitive member 2 by about 1.6 mm at the time of the image output on $450\times10^3$ sheets. As a result, a degree of sliding of the charger shutter on the photosensitive member 1 was large and therefore, the charger shutter caused the improper opening and closing operation.

Further, under the condition 3 corresponding to a further constitution in Comparative Embodiment, the charger shutter was wound up without being permanent-set so that the corona charger-side surface was outside, so that the portion in the neighborhood of the longitudinal central portion of the charger shutter was bent toward the corona charger 2 by about 2.0 mm at the time of the image output on $200\times10^3$ sheets. As a result, the charger shutter caused the improper opening and closing operation and at the same time, the image defect was caused to occur due to the transfer of the toner and the electric discharge product from the charger shutter onto the grid electrode.

From the above verification experiment, it is understood that the bending of the charger shutter due to the permanent set by the winding-up roller can be alleviated irrespective of the winding-up direction by imparting the shape of curvature to the charger shutter in advance as under the condition 1 corresponding to the constitution in this embodiment and the condition 2 corresponding to the constitution in Comparative Embodiment. However, under the condition 2, the winding-up direction was opposite from that under the condition 1, so that the charger shutter caused non-negligible bending during the verification experiment (at the time before the print number reaches $1,000\times10^3$ sheets).

On the other hand, under the condition 1 corresponding to the constitution in this embodiment, the charger shutter is configured to be wound up so that the corona charger-side surface (convex surface) is inside, so that it is understood that the bending of the charger shutter toward the corona charger can be alleviated while being suppressed by the shape of curvature imparted to the charger shutter by the permanent set by using the winding-up roller.

As described above, by employing the constitution in this embodiment, it was confirmed that the opening and closing operation of the charger shutter 10 was capable of being smoothly and stably performed even when the charger shutter 10 was left standing for a long time in the wound-up state. Further, it was confirmed that it was possible to prevent the occurrence of the improper charging due to the transfer of the toner and the electric discharge product from the charger shutter onto the grid electrode.

Embodiment 3

Next, Embodiment 3 will be described. In this embodiment, members or means having the same functions as those described in Embodiments 1 and 2 are represented by the same reference numerals or symbols, thus being omitted from redundant description as long as there is no need.

In Embodiments 1 and 2, the charger shutter is configured to be moved along its longitudinal direction (the generating line of the photosensitive member (main scan direction)) to be opened and closed but is configured in this embodiment so that the condition is moved along its widthwise direction (the circumferential direction of the photosensitive member (sub-scan direction)) to be opened and closed. Further, in this embodiment, similarly as in Embodiment 2, the charger shutter 10 is not subjected to the permanent-set treatment for imparting the shape of curvature to the charger shutter 10 in advance but the curvature shape imparting mechanism is provided. This constitution will be described specifically below.

FIGS. 13(A) and 13(B) are schematic views, wherein FIG. 13(A) shows an open state and FIG. 13(B) shows a closed state.

As shown in FIGS. 13(A) and 13(B), the charger shutter 10 is opened and closed, in the small gap between the photosensitive member 1 and the corona charger 2, along the photosensitive member circumferential direction (sub-scan direction), i.e., the widthwise direction of the charger shutter 10.

In this embodiment, in order to permit movement of the charger shutter 10 such that the sheet-like charger shutter 10 is opened and closed with respect to the sub-scan direction while following the shape of curvature of the photosensitive member 1, the curvature shape imparting mechanism 12*e* as the regulating means for imparting the shape of curvature to the charger shutter 10 is provided. In other words, the curvature shape imparting mechanism 12*e* regulates the shape of the charger shutter 10 so that the widthwise central portion of the charger shutter 10 protrudes toward the corona charger 2 in the closed state of the charger shutter 10.

At each of the longitudinal both end portions of the charger shutter 10, the curvature shape imparting mechanism 12*e* includes a pair of curvature shape imparting members $\mathbf{12}e_2$ so as to sandwich the charger shutter 10. These two pairs of the curvature shape imparting members $\mathbf{12}e_2$ are fixed to the corona charger 2, so that the shape of curvature is imparted to the charger shutter 10 while the charger shutter 10 slides on the two pairs of the curvature shape imparting members $\mathbf{12}e_2$. That is, these two pairs of the curvature shape imparting members $\mathbf{12}e_2$ also perform the function as a moving guide for the charger shutter 10.

Figure 13:
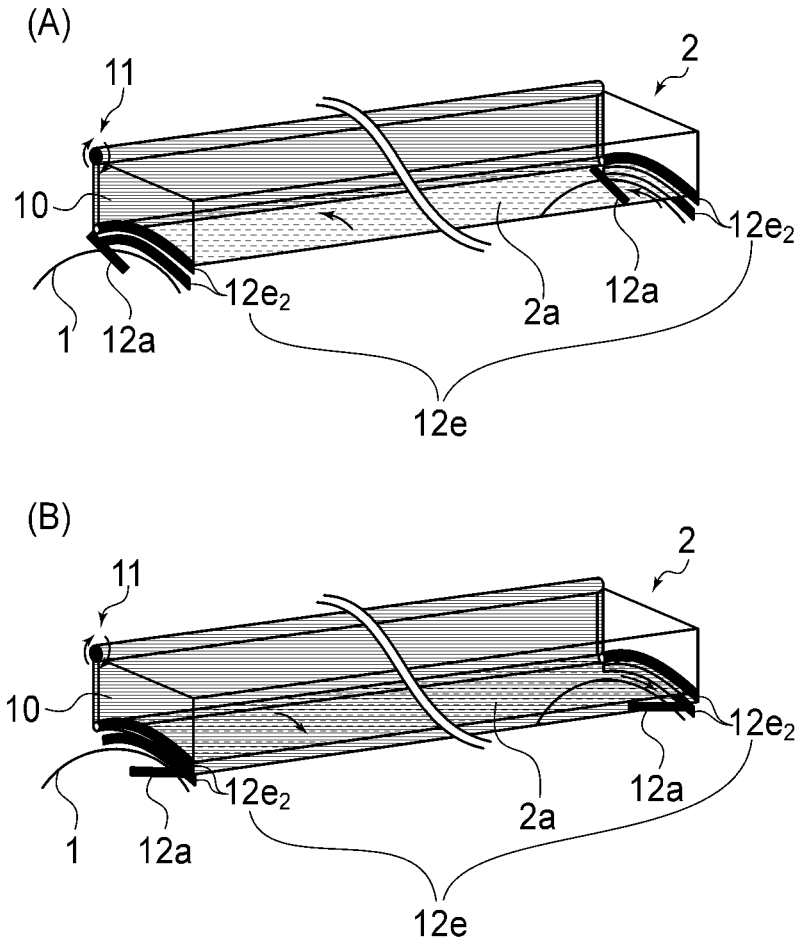
Figure 14:
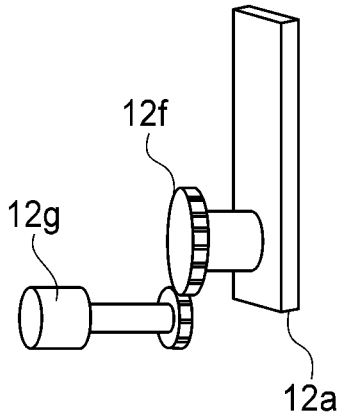
FIG. 14 is a schematic perspective view showing the charger shutter opening and closing mechanism.

Further, the charger shutter 10 is fixed to the movable member 12*a*, which is connected to an opening and closing drive mechanism as shown in FIG. 13. This opening and closing mechanism includes a driving gear 12*f* fixed to the movable member 12*a* and a driving motor 12*g* for rotationally driving the driving gear 12*f*. Therefore, the driving motor 12*g* is actuated to rotationally drive the driving gear 12*f* and the movable member 12*a*, so that the opening and closing movement of the charger shutter 10 is effected.

Further, the winding-up device 11 for winding up the charger shutter 10 in a roll shape is provided at a corner portion above the corona charger 2 in order to save a space. This winding-up device 11 includes, similarly as in Embodiment 1, the winding-up roller 11*b* and the spring 11*a* contained in the winding-up roller 11*b*.

Specifically, as shown in FIG. 13(A), the charger shutter 10 is opened by rotationally driving the movable member 12*a* in the counterclockwise direction. In this case, similarly as in Embodiment 1, the charger shutter 10 is configured to be wound up without being slacked by the spring 11*a* as the urging member contained in the winding-up roller 11*b*.

On the other hand, as shown in FIG. 13(B), the charger shutter 10 is closed by rotationally driving the movable member 12*a* in the clockwise direction. In this case, similarly as in Embodiment 1, the charger shutter 10 is configured to be under tension without being slacked by the spring 11*a* contained in the winding-up roller 11*b*.

Further, also in this embodiment, as shown in FIG. 13(A), such a constitution that the charger shutter 10 is wound up by the winding-up roller 11*b* so that the convex surface of the shape of curvature imparted to the charger shutter 10 by the curvature shape imparting members $\mathbf{12}e_2$ is inside is employed.

In other words, the charger shutter 10 configured to be wound up by the winding-up roller 11*b* so that the surface of the charger shutter 10 protruding toward the corona charger 2 is inside.

Therefore, also in this embodiment, similarly as in Embodiments 1 and 2, it is possible to smoothly and stably perform the opening and closing operation of the charger shutter 10 even when the charger shutter 10 is left standing for a long time in the wound-up state. Further, it is possible to prevent the occurrence of the improper charging due to the transfer of the toner and the electric discharge product from the charger shutter 10 onto the grid electrode 2*a*.

Incidentally, in this embodiment, similarly as in Embodiment 1, it is also possible to employ the constitution in which the charger shutter 10 has been permanent-set in advance so as to have the shape of curvature without employing the constitution in which the curvature shape imparting mechanism for imparting the shape of curvature to the charger shutter 10 is not used.

The present invention is not limited to Embodiments 1 to 3 described above.

For example, it is possible to use the constitutions in Embodiments 1 and 2 in combination. That is, such a constitution that the charger shutter 10 has been permanent-set in advance and then is subjected to impartment of the shape of curvature by the curvature shape imparting mechanism may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 324480/2008 filed Dec. 19, 2008, which is hereby incorporated by reference.

What is claimed is:

1. A charging device comprising:

a corona charger including a shield provided with an opening opposed to a photosensitive member and a discharging wire disposed in said shield and configured to electrically charge said photosensitive member;

a sheet-like member configured to open and close said opening by moving substantially along a longitudinal direction of said shield;

a regulating member configured to regulate a shape of said sheet-like member so that a central portion of said sheet-like member protrudes more toward said discharging wire than both end portions of said sheet-like member in a widthwise direction of said sheet-like member; and a winding-up member configured to wind up said sheet-like member with an opening movement of said sheet-like member so that a surface of which said sheet-like member is opposed to said discharging wire is directed toward a winding-up axis of said winding-up member.

2. The charging device according to claim 1, wherein said regulating member is fixed to one end of said sheet-like member located out of a winding-up range of said winding-up member.

3. The charging device according to claim 1, wherein said regulating member regulates the shape of said sheet-like member while sliding on said sheet-like member.

4. The charging device according to claim 1, wherein the winding-up axis of said winding-up member is substantially parallel to the widthwise direction of said sheet-like member.

5. The charging device according to claim 1, further comprising an urging member configured to impart an urging force to said winding-up member in order to wind up said sheet-like member around said winding-up member with the opening movement of said sheet-like member.

6. The charging device according to claim 1, wherein said corona charger further includes a grid electrode, and a central portion of said grid electrode protrudes more toward said discharging wire than both end portions of said grid electrode in a widthwise direction of said shield.

7. A charging device comprising:

a corona charger including a shield provided with an opening opposed to a photosensitive member and a discharging wire disposed in said shield and configured to electrically charge said photosensitive member;

a sheet-like member configured to open and close said opening by moving substantially along a longitudinal direction of said shield, wherein said sheet-like member has been permanent-set in advance so as to have a shape so that a central portion of said sheet-like member protrudes more toward said discharging wire than both end portions of said sheet-like member in a widthwise direction of said sheet-like member; and a winding-up member, configured to wind up said sheet-like member with an opening movement of said sheet-like member so that a surface of which said sheet-like member is opposed to said discharging wire is directed toward a winding-up axis of said winding-up member.

8. The charging device according to claim 7, wherein the winding-up axis of said winding-up member is substantially parallel to the widthwise direction of said sheet-like member.

9. The charging device according to claim 7, further comprising an urging member configured to impart an urging force to said winding-up member in order to wind up said sheet-like member around said winding-up member with the opening movement of said sheet-like member.

* * * * *